US011047218B2

(12) United States Patent
Zeghlache et al.

(10) Patent No.: US 11,047,218 B2
(45) Date of Patent: Jun. 29, 2021

(54) SIMULTANEOUS INJECTION AND FRACTURING INTERFERENCE TESTING

(71) Applicant: Saudi Arabian Oil Company, Dhahran (SA)

(72) Inventors: Mohamed Larbi Zeghlache, Al Khubar (SA); Mark Proett, Missouri Cit, TX (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/921,701

(22) Filed: Jul. 6, 2020

(65) Prior Publication Data

US 2020/0332634 A1 Oct. 22, 2020

Related U.S. Application Data

(62) Division of application No. 15/630,305, filed on Jun. 22, 2017, now Pat. No. 10,704,369.

(51) Int. Cl.
*E21B 43/16* (2006.01)
*E21B 43/26* (2006.01)
(Continued)

(52) U.S. Cl.
CPC ..... *E21B 43/162* (2013.01); *E21B 43/16* (2013.01); *E21B 43/26* (2013.01); *E21B 43/30* (2013.01);
(Continued)

(58) Field of Classification Search
CPC ..... E21B 43/16; E21B 43/162; E21B 43/26; E21B 43/30; E21B 47/06; E21B 49/006; E21B 49/008; E21B 49/087
See application file for complete search history.

(56) References Cited

U.S. PATENT DOCUMENTS 5,050,674 A 9/1991 Soliman et al.
5,555,945 A * 9/1996 Schultz ..... E21B 33/1243 166/250.07
(Continued)

FOREIGN PATENT DOCUMENTS

EP 2163724 3/2010
WO 2012173608 12/2012

OTHER PUBLICATIONS

International Search Report and Written Opinion issued in International Application No. PCT/US2018/038079 dated Sep. 5, 2018, 16 pages.
(Continued)

*Primary Examiner* — Matthew R Buck
(74) *Attorney, Agent, or Firm* — Fish & Richardson P.C.

(57) ABSTRACT

Fluids are pumped into the wellbore by pulsing the fluids at a variable, positive pressure relative to the geologic formation until a first pressure threshold in the first fracture zone is satisfied. The pumping results in a first pressure profile in the first fracture zone representing pressures in the first fracture zone over time responsive to the pumping, and a second pressure profile in the second zone representing pressures in the second zone over time responsive to the pumping. In response to determining that the first pressure threshold is satisfied, the fluids are ceased to pump into the wellbore for a duration of time. After the duration of time, the fluids are re-pumped into the wellbore by pulsing the fluids at the variable, positive pressure relative to the geologic formation until a second pressure threshold in the first fracture zone in the first fracture zone is satisfied.

8 Claims, 5 Drawing Sheets

(51) Int. Cl.

| | |
|---|---|
| ***E21B 43/30*** | (2006.01) |
| ***E21B 47/06*** | (2012.01) |
| ***E21B 49/00*** | (2006.01) |
| ***E21B 49/08*** | (2006.01) |
| *E21B 43/00* | (2006.01) |

(52) U.S. Cl.
CPC ..... *E21B 47/06* (2013.01); *E21B 49/006* (2013.01); *E21B 49/008* (2013.01); *E21B 49/087* (2013.01); *E21B 43/00* (2013.01)

(56) References Cited

U.S. PATENT DOCUMENTS 5,789,669 A * 8/1998 Flaum ..... E21B 49/10 73/152.51
6,076,046 A 6/2000 Vasudevan et al.
6,675,892 B2 * 1/2004 Kuchuk ..... E21B 49/087 166/250.02
6,832,515 B2 12/2004 Follini et al.
7,024,930 B2 4/2006 Follini et al.
7,031,841 B2 * 4/2006 Zazovsky ..... E21B 49/008 702/12
7,032,661 B2 * 4/2006 Georgi ..... E21B 49/00 166/250.01
7,036,578 B2 5/2006 Austbo et al.
7,054,751 B2 5/2006 Craig
7,117,734 B2 10/2006 Follini et al.
7,210,334 B2 5/2007 Seghers et al.
7,263,880 B2 9/2007 Pop et al.
7,290,443 B2 11/2007 Follini et al.
7,445,043 B2 11/2008 Mullins et al.
7,788,037 B2 8/2010 Soliman et al.
8,015,869 B2 * 9/2011 Nold, III ..... E21B 49/008 73/152.51
8,899,349 B2 12/2014 Rasmus et al.
8,985,218 B2 3/2015 Bedouet et al.
9,033,045 B2 * 5/2015 Fincher ..... E21B 43/263 166/308.1
9,045,969 B2 * 6/2015 Waters ..... E21B 49/008
9,422,811 B2 8/2016 Bedouet et al.
9,477,002 B2 * 10/2016 Miller ..... G01V 1/46
2007/0079652 A1 * 4/2007 Craig ..... E21B 49/008 73/152.22
2007/0083331 A1 * 4/2007 Craig ..... E21B 49/008 702/13
2009/0250207 A1 * 10/2009 May ..... E21B 49/008 166/250.1
2012/0111559 A1 * 5/2012 Deady ..... E21B 49/006 166/250.1
2014/0182844 A1 * 7/2014 Wutherich ..... E21B 41/0092 166/250.02
2014/0262232 A1 9/2014 Dusterhoft et al.
2015/0075777 A1 3/2015 Walters et al.
2015/0075778 A1 3/2015 Walters et al.
2015/0075779 A1 3/2015 Walters et al.
2017/0138187 A1 * 5/2017 Moronkeji ..... E21B 33/12
2018/0334903 A1 * 11/2018 Lehr ..... E21B 47/06

OTHER PUBLICATIONS

Gulf Cooperation Council Examination Report issued in GCC Application No. 2018-35517 dated Dec. 12, 2019, 4 pages.
Gasda et al., "Wellbore Permeability Estimates from Vertical Interference Testing of Existing Wells," Energy Procedia, vol. 37, Jan. 1, 2013, 8 pages.
Kuchuk et al., "The use of Vertical Interference Testing to improve reservoir interference testing to improve reservoir characterization," SPE, Oct. 18, 2000, 13 pages.

* cited by examiner

SIMULTANEOUS INJECTION AND FRACTURING INTERFERENCE TESTING

CROSS REFERENCE TO RELATED APPLICATION

This application is a divisional of U.S. patent application Ser. No. 15/630,305 filed on Jun. 22, 2017, entitled "SIMULTANEOUS INJECTION AND FRACTURING INTERFERENCE TESTING", the contents of which are incorporated by reference herein in its entirety.

TECHNICAL FIELD

This specification relates to geologic formation testing within a wellbore.

BACKGROUND

When producing fluids from a geologic formation, it can be helpful to know certain properties of the geologic formation. Several tests to determine geo-mechanical properties of the geological formation can be performed after a wellbore has been drilled into the geologic formation. Such tests can include a vertical interference test and an injection fall-off test. Vertical interference testing normally involves pumping fluid out of the geologic formation and into the wellbore while monitoring a pressure signal with a pressure sensor. An injection fall-off test involves pumping a small volume of fluid into the geologic formation until a fracture is initiated, followed by natural pressure fall-off due to fracture closure.

SUMMARY

This specification describes technologies relating to injection and fracturing interference testing.

An example implementation of the subject matter describes within this disclosure is a method with the following features. A wellbore is formed into a geologic formation with a first fracture zone and a second zone. The second zone is outside the first fracture zone. The wellbore passes through both the first fracture zone and the second zone. fluids are pumped into the wellbore by pulsing the fluids at a variable, positive pressure relative to the geologic formation until a first pressure threshold in the first fracture zone is satisfied. The pumping results in a first pressure profile in the first fracture zone representing pressures in the first fracture zone over time responsive to the pumping, and a second pressure profile in the second zone representing pressures in the second zone over time responsive to the pumping. In response to determining that the first pressure threshold is satisfied, the fluids are ceased to pump into the wellbore for a duration of time. After the duration of time, the fluids are re-pumped into the wellbore by pulsing the fluids at the variable, positive pressure relative to the geologic formation until a second pressure threshold in the first fracture zone in the first fracture zone is satisfied. The second pressure threshold is different from the first pressure threshold. The re-pumping results in a third pressure profile in the first fracture zone representing pressures in the first fracture zone over time responsive to the pumping. In response to determining that the second pressure threshold is satisfied, ceasing to re-pump the fluids into the wellbore until a third pressure threshold in the first fracture zone is satisfied, the third pressure threshold different from the second pressure threshold. Mechanical properties of the geologic formation are determined based on the first pressure profile, the second pressure profile, and the third pressure profile.

Aspects of the example method, which can be combined with the example method alone or in combination, include the following. The second pressure threshold can be greater than the first pressure threshold.

Aspects of the example method, which can be combined with the example method alone or in combination, include the following. The determined mechanical properties can include a vertical permeability.

Aspects of the example method, which can be combined with the example method alone or in combination, include the following. An acoustic response can be measured during the re-pumping. The mechanical properties can include a fracture geometry determined based on the acoustic response.

Aspects of the example method, which can be combined with the example method alone or in combination, include the following. While pumping the fluids into the wellbore, a first plurality of pressure values can be measured over time by a first sensor in the first fracture zone, and a second plurality of pressure values over time in the second zone by a second sensor in the second zone. It can be determined that the second plurality of pressures within the second zone satisfy a pressure threshold in the first fracture zone.

Aspects of the example method, which can be combined with the example method alone or in combination, include the following. After ceasing to pump the fluids into the wellbore, a third plurality of pressure values over time in the first fracture zone can be measured by the first sensor and the second sensor, resulting in a third pressure profile and a fourth plurality of pressure values over time in the second zone resulting in a fourth pressure profile, respectively.

Aspects of the example method, which can be combined with the example method alone or in combination, include the following. The pumping and re-pumping can be implemented in a single trip of a wellbore tool into the wellbore.

Aspects of the example method, which can be combined with the example method alone or in combination, include the following. In the single trip, the wellbore tool is not removed from within the wellbore after ceasing the pumping and before the re-pumping.

An example implementation of the subject matter describes within this disclosure is a second method with the following features. A wellbore tool is assembled based on a set of estimated geo-mechanical properties of a formation in which the wellbore is formed. The wellbore tool is inserted into the wellbore to be in-line with a testing zone. An upper packer nearer an uphole end of the testing zone and a lower packer nearer a downhole end of the testing zone are sealed against a wall of the wellbore. Each packer is attached to the wellbore tool. The wellbore is pressurized between the upper packer and the lower packer by pulsing a fluid at a variable, positive pressure relative to a geologic formation. A first downhole property is measured with respect to time by a first sensor package positioned between the upper packer and the lower packer. A second downhole property is measured with respect to time by a second sensor package. A set of geo-mechanical properties of the formation is determined based on the first downhole property with respect to time and the second downhole property with respect to time. The geo-mechanical properties include a vertical permeability of the formation.

Aspects of the example second method, which can be combined with the example second method alone or in combination, include the following. Assembling a wellbore tool based on a set of estimated geo-mechanical properties of a formation in which the wellbore is formed can include determining a type of sensor to include with the sensor package.

Aspects of the example second method, which can be combined with the example second method alone or in combination, include the following. The sensor package can include an acoustic sensor.

Aspects of the example second method, which can be combined with the example second method alone or in combination, include the following. The determined geo-mechanical properties can include a fracture geometry. Determining a fracture geometry can include analyzing a signal from the acoustic sensor.

Aspects of the example second method, which can be combined with the example second method alone or in combination, include the following. The set of estimated geo-mechanical properties can be updated based on the set of determined geo-mechanical properties. Updating the set of estimated geo-mechanical properties can include replacing a set of estimated values with a set of empirical values.

Aspects of the example second method, which can be combined with the example second method alone or in combination, include the following. a future wellbore route through the geologic formation is planned based on the set of determined geo-mechanical properties.

Aspects of the example second method, which can be combined with the example second method alone or in combination, include the following. A fracking pressure of the formation is determined based on the set of determined geo-mechanical properties.

An example implementation of the subject matter describes within this disclosure is a third method with the following features. a vertical interference test is performed within a wellbore with a wellbore tool inserted into the wellbore during a trip into the wellbore. Within the same trip, an injection fall-off test is performed within the wellbore. A set of geo-mechanical properties is determined based on a set of results from both the vertical interference test and the injection fall-off test.

Aspects of the example third method, which can be combined with the example third method alone or in combination, include the following. Performing a vertical interference test and performing an injection fall-off test can occur simultaneously.

Aspects of the example third method, which can be combined with the example third method alone or in combination, include the following. Performing a vertical interference test can include pumping a fluid at a greater pressure than a formation pressure within the wellbore. The formation pressure is a required threshold pressure for fluid to flow into the formation from the wellbore.

Aspects of the example third method, which can be combined with the example third method alone or in combination, include the following. An injection fall-off test can include pumping a fluid at a sufficient pressure to start fracturing a formation.

Aspects of the example third method, which can be combined with the example third method alone or in combination, include the following. The determined geo-mechanical properties can include a fracture geometry.

The details of one or more implementations of the subject matter described in this specification are set forth in the accompanying drawings and the description later within this specification. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Both a vertical interference test (VIT) and a diagnostic fracture test (DFIT™), also known as a pre-frac test, injection fall-off test, a data-frac, or a mini-frac, are tests that can be used to determine mechanical properties of a geologic formation. For example, a VIT can be used to determine a horizontal and vertical permeability, while a mini-frac can be used to determine a minimum fracture initiation pressure. Traditionally, these tests are performed with different wellbore testing tools and must be performed in separate trips down the wellbore. If a situation arises where both tests need to be performed, the need for two trips can cost excessive time and money.

This specification describes a method for testing geo-mechanical properties of a geologic formation surrounding a wellbore. The tested properties include vertical permeability and fracture-ability. The method involves performing a VIT to determine a horizontal and vertical permeability of the formation, and performing a mini-frac to determine the fracture-ability of the formation. The tests are performed with the same testing apparatus simultaneously. That is, the testing apparatus is not removed from the wellbore between tests. The tests can also be started at the same time, or certain aspects of each test can be performed at the same time. Details on overlapping aspects of the tests are discussed in detail later in this disclosure. Such a system saves considerable time and money over previous methods. Additionally, extra sensors can be added to the wellbore tool to determine more geo-mechanical properties within the single trip. The geo-mechanical properties that can be determined include but not limited to Young's modulus, Poisson's ratio, in situ stresses, electrical properties (conductivity and dielectric) and the direction or spatial variability of these properties when multiple sensors are used. These properties can also be used with other logging measurements to determine additional interpreted properties such as water, oil and gas saturations in the rock pore space.

Figure 1:
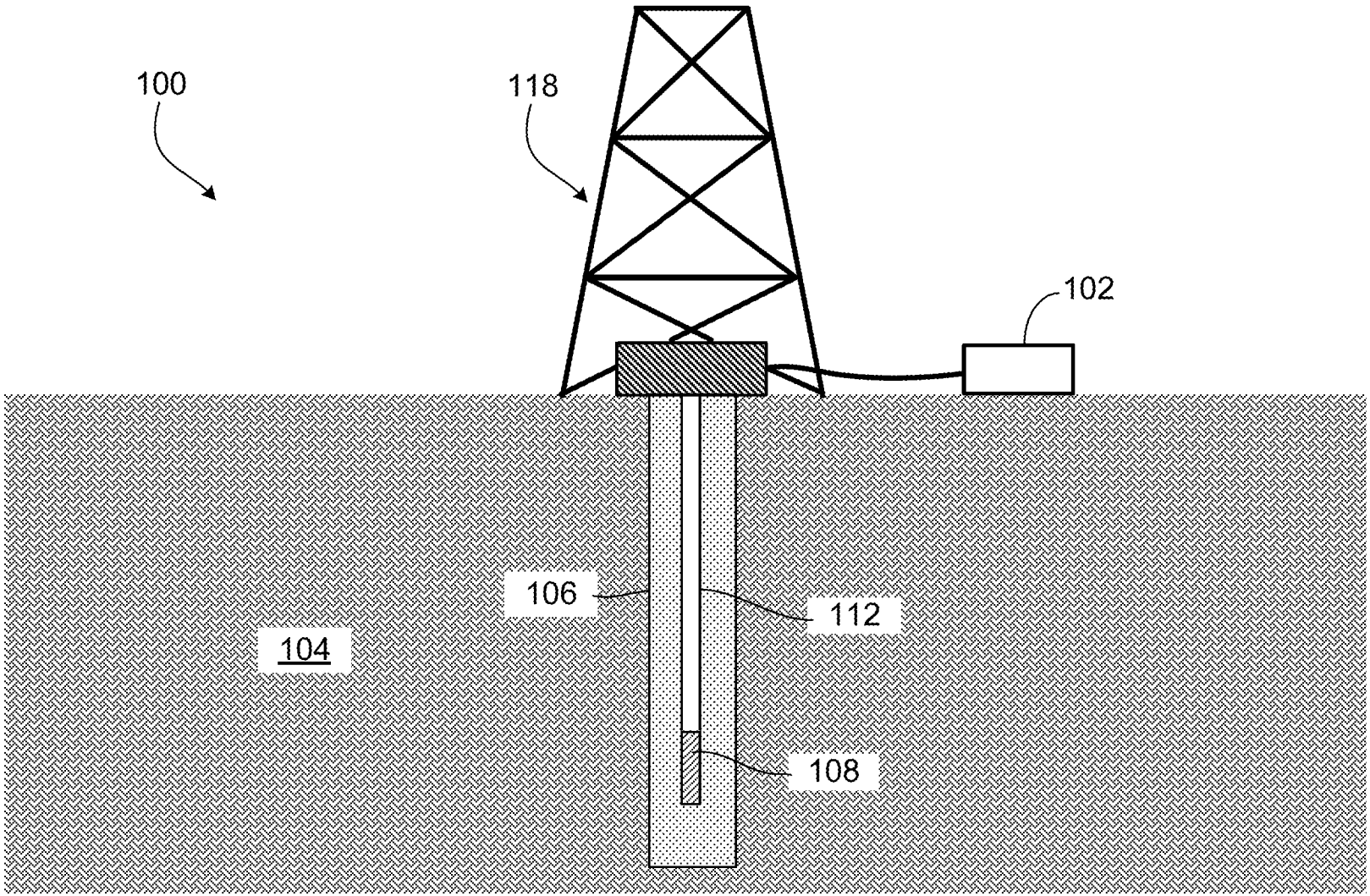
FIG. 1 is schematic diagram of a side view of an example string within a wellbore.

FIG. 1 shows a wellbore testing system 100. The testing system 100 includes a wellbore testing tool 108 positioned within a wellbore 106. The wellbore testing tool 108 is supported and transported through the wellbore 106 with a testing string 112. The wellbore tool can be used to determine mechanical properties of a geologic formation 104 in which the wellbore 106 has been formed. The string 112 can be supported by a derrick 118. While the illustrated implementation shows the wellbore testing tool 108 being deployed with the string 112 and the derrick 118, the wellbore testing tool 108 could also be deployed with a coiled tubing or wireline set-up. The wellbore testing tool 108 can be deployed with any conveyance method, including but not limited to; drill-pipe, coiled tubing, a wireline set-up, or any other form of conveyance. A computer 102 located at a topside facility can control the wellbore testing tool 108 and to collect and analyze data from wellbore testing tool 108. Alternatively, or in addition, the computer 102 (or a different computer) can be located within the wellbore 106 or off-site, coupled (using wires or wirelessly or both) to the computer 102 at the well site. While the illustrated implementation shows the wellbore testing tool 108 being deployed in a vertical wellbore, the wellbore testing tool 108 can also be used in a deviated or horizontal wellbore.

Figure 2:
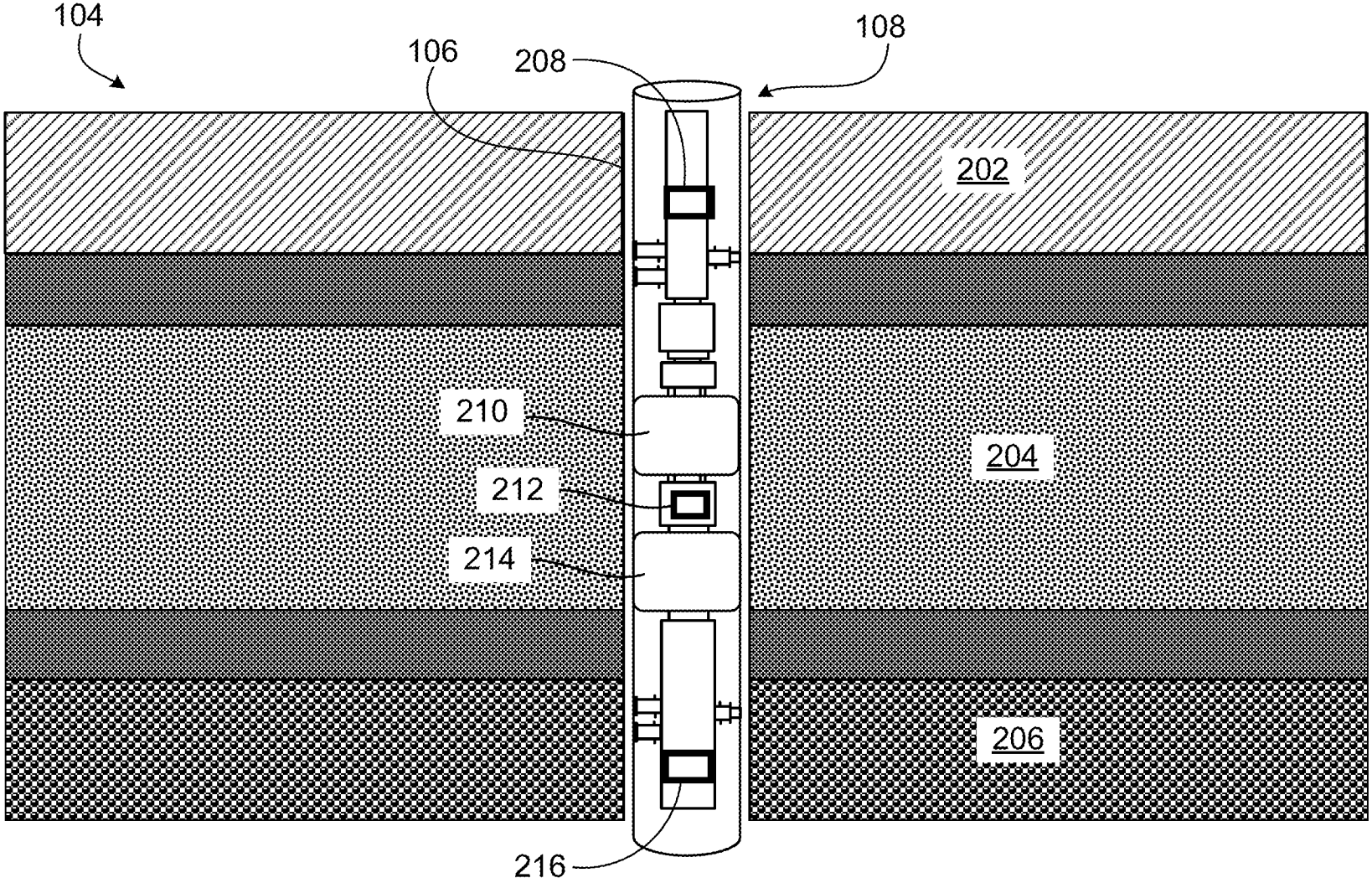
FIG. 2 is a schematic diagram of an example wellbore testing tool positioned within a wellbore.

FIG. 2 shows a detailed view of an example wellbore testing tool 108 deployed in the wellbore 106. The wellbore testing tool can include an upper packer 210 attached nearer an uphole end of the wellbore testing tool 108 than a downhole end of the wellbore testing tool 108, and a lower packer 214 attached nearer the downhole end up the wellbore testing tool 108 than the downhole end of the wellbore testing tool 108. The packers can be inflatable packers, or any other type of packer that can sufficiently, hydraulically isolate a target section of the wellbore 106 from the rest of the wellbore 106. A first sensor package 212 is attached to the wellbore tool 108 between the upper packer 210 and the lower packer 214. The first sensor package 212 can include one or more sensors, such as a temperature sensor, a pressure sensor, a sonic sensor, an ultrasonic sensor, a resistivity sensor, a dielectric sensor, an electrostatic sensor, or any other sensor suitable for a wellbore environment. The wellbore tool 108 also includes a second sensor package 208 located uphole of the upper packer 210. The second sensor package 208 can also include multiple sensors, such as a temperature sensor, a pressure sensor, a sonic sensor, an ultrasonic sensor, a resistivity sensor, a dielectric sensor, an electrostatic sensor, or any other sensor suitable for a wellbore environment. In some implementations, the wellbore testing tool 108 can include a third sensor package 216 located downhole of the lower packer 214. The third sensor 216 package can include multiple sensors, such as a temperature sensor, a pressure sensor, a sonic sensor, an ultrasonic sensor, a resistivity sensor, a dielectric sensor, an electrostatic sensor, or any other sensor suitable for a wellbore environment. The third sensor package 216 can include sensor used to determine different rock properties from those determined by the first sensor package 212 or the second sensor package 208. If two sensor packages are used, variations in properties can determine in two dimensions, such as along the wellbore. The use of three sensor packages can result in detecting property variations in three dimensions and resolve the direction that certain formation properties are changing. The spacing between each sensor package can vary between different implementations. Factors such as depth, formation sensitivity, size of zones, and other factors can determine the spacing of the sensor packages. The sensors for each sensor package are chosen based upon a set of estimated petrophysical and geo-mechanical properties of the formation 104 in which the wellbore 106 is formed. The sensors within the sensor package can be omnidirectional or azimuthally oriented.

In the illustrated example, the wellbore tool 108 is inserted into the wellbore 106 to be in-line with a testing zone 204 of the formation 104. The formation 104 also includes a second zone 202 that is outside the first fracture zone 204. In some implementations, the formation 104 can include a third zone 206 that is outside the first fracture zone 204 and is separated from the second zone 202 by the first fracture zone 204. Measurement in the third zone 206 can help determine the vertical connectivity between the first zone 204, the second zone 202, and the third zone 206. Measurements in the third zone 206 can also help estimate changes in the physical properties of each zone when 204 is undergoing an injection or fracturing test. Having both results from the second zone 202 and the third zone 206 can help determine heterogeneity in the formation along the borehole above and below the testing zones. The upper packer 210 seals against a wall of the wellbore 106 nearer an uphole end of the testing zone 204 and the lower packer 214 seals against a wall of the wellbore 106 nearer a downhole end of the testing zone 204. During some tests on the formation 104, a fluid is pulsed at a variable, positive pressure relative to a geologic formation 104 to pressurize the wellbore 106 between the upper packer 210 and the lower packer 214. That is, fluid is pressurized to the point that the fluid flows from the wellbore 106 into the formation 104. The variable, positive pressure pulses can be driven by a pump at a topside facility or a downhole pump. In some implementations, the pumping and sealing can be controlled by the computer 102. In such a test, the first sensor package 212 can measure a first downhole property with respect to time by the first sensor package 212. For example, the first sensor package 212 can measure a pressure of the adjacent first zone 204 within the wellbore 106. That is, a pressure of the wellbore containing the first sensor package 212 is measured; the first zone 204 is fluidically connected to this section, so the pressure of the first zone 204 can be determined based on the readings from the first sensor package 212. While a pressure is being measured in the first zone 204, the pressure can also be measured in the second zone 202. In certain testing scenarios, the wellbore is pressurized to sufficiently begin to fracture the first zone 204. In such an example, the first sensor package 212 can include an acoustic sensor to detect the soundwaves emitted by the fracturing process. Based on these readings, fracture geometries can be determined. In some implementations, the downhole properties with respect to time are recorded and processed by the computer 102.

Simultaneously, a second downhole property can be measured with respect to time by the second sensor package 208. For example, a pressure within the wellbore 106 of the adjacent second zone 202 can be measured. During a VIT, the pressure within the wellbore 106 is increased to be higher than the pressure of the first zone 204. That is, fluid flows from the wellbore 106 and into the first zone 204. The fluid can flow from the first zone 204 and into the second zone 202. The additional fluid flow between the first zone 204 and the second zone 202 creates a pressure differential that can vary with time. In some implementations, a third downhole property can be measured with respect to time by the third sensor package 216. For example, a pressure within the wellbore 106 of the adjacent third zone 206 can be measured. Similar to the previously described VIT, the pressure within the wellbore 106 is increased to be higher than the pressure of the first zone 204. That is, fluid flows from the wellbore 106 and into the first zone 204. The fluid can flow from the first zone 204 and into the third zone 206. The additional fluid flow between the first zone 204 and the third zone 206 creates a pressure differential that can vary with time. A set of geo-mechanical properties of the formation can be determined based on the first downhole property with respect to time and the third downhole property with respect to time. For example, a vertical permeability of the formation 104 can be determined. Specifically, the vertical permeability of the formation 104 can be calculated based on the rate of pressure change between the first zone 204 and either the second zone 202 or the third zone 206. Higher permeabilities can result in a higher pressure change while low permeabilities can result in a lower pressure change. In addition, fluid flows slower in lower permeability formation causing a delay in time form the injection in one location to the detection of a change in another location. In some implementations, the computer 102 can be used to calculate the horizontal and vertical permeability, or any other desired parameter that can be determined from the collected data. The data collected can include analog signals or digital samples. In some implementations, the third set of geo-mechanical properties can be determined using the third downhole property with respect to time. In some implementations, such as when an acoustic sensor is included in one of the sensor packages, a fracture geometry can be determined.

In one example, when a fracture is initiated, induced energy in the rock is captured as micro-seismic events using geophones or hydrophones as part of the first sensor package 208 and the third sensor package 216 in array set-up. For example, the second sensor package 208 can contain eight arrays of four azimuthal micro-seismic geophones. Recorded time domain data can then be used to map an induced fracture and estimate properties of the induced fracture, such as half-length and angle If sufficient measurements are made with various sensors the three-dimensional shape of the fracture can be determined.

Geo-mechanical properties, such as fracture geometry or vertical permeability, can be determined by interpreting the data gathered by the sensor packages. The empirically determined geo-mechanical properties can be used to update the set of estimated geo-mechanical properties. That is, the original estimated values of the geo-mechanical properties that were used to select the sensors to be included in each sensor package can be updated with the set of empirical values. The estimated geo-mechanical properties can be based upon values in a similar geologic formation, values determined in another section of the formation 104, or from any other basis for estimating geo-mechanical properties. In some implementations, the estimated geo-mechanical properties can be calculated and stored using the computer 102. The updated geo-mechanical properties can be used in a geologic model that can be used to help plan a future wellbore route through the geologic formation, determine a fracking pressure required to fracture the formation, or plan any other operation that needs to be performed within the geologic formation. For example, a separate wellbore can be drilled within the geologic formation 104. The separate wellbore can be fractured to increase production rates. In some implementations, the geologic model can be stored and utilized with the computer 102.

Figure 3:
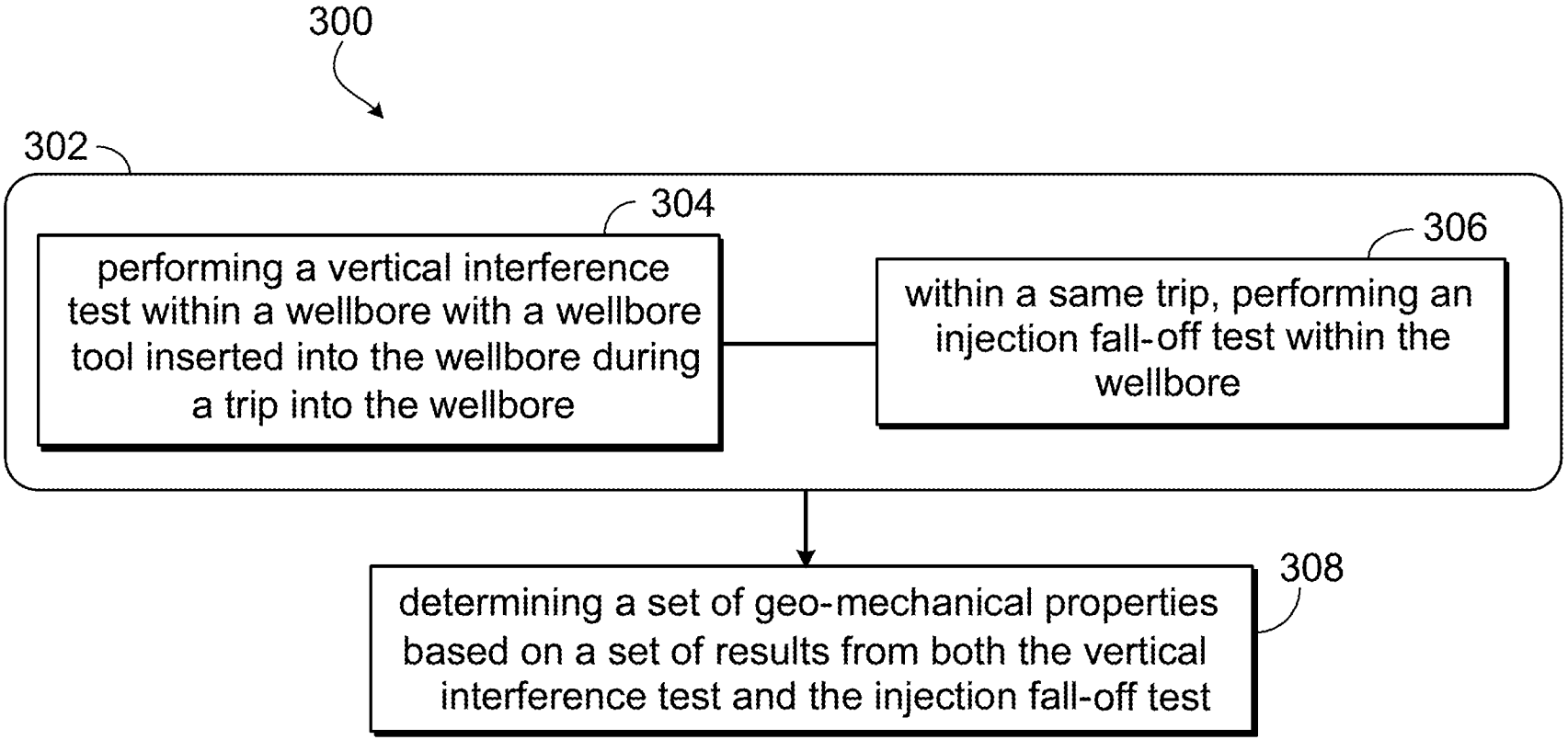
FIG. 3 is a flowchart showing an example method of an injection and fracturing interference test.

The wellbore tool 108 can be used for a variety of tests. Such an example test is shown in FIG. 3. FIG. 3 is a flowchart of an example method 300 that can be used to perform a test with the wellbore testing tool 108. At 304, a vertical interference test (VIT) is performed within the wellbore 106 with the wellbore testing tool 108. At 306, an injection fall-off test (also called a mini-frac) is performed within the wellbore. At 302, both the VIT (304) and the mini-frac (306) are performed within the same trip. In other words, performing a VIT (304) and performing a mini-frac (306) occur simultaneously. For example, both tests use the same input: a variable, positive pressure. At 308 a set of geo-mechanical properties are determined based on a set of results from both the VIT (304) and the mini-frac (306). In some implementations, the computer 102 can control the previously mentioned tests, store the results from the previously mentioned tests, process the results from the previously mentioned tests, or a combination.

A VIT includes pumping a fluid at a greater pressure than a formation pressure within the wellbore. The formation pressure is a required threshold pressure for fluid to flow from the wellbore and into the formation. A mini-frac can include pumping a fluid at a sufficient pressure to start fracturing the formation, typically a higher pressure than that of the VIT. In implementations where an acoustic sensor is used, the acoustic sensor can detect the sounds produced by the formation beginning to fracture. As discussed earlier these sounds can be analyzed to determine fracture geometries. In some implementations, acoustic sensors can be included in the first sensor package 212, the second sensor package 208, and the third sensor package 216. That is, the acoustic sensors can be positioned uphole of the fracture zone 204. Each of the sensor packages can include acoustic sensors arranged azimuthally around and longitudinally around the wellbore tool 108. In some implementations, each acoustic sensor is an array of acoustic sensors. When fractures are induced, the formation stress is increased and pore pressure is increased due to injected fluid leak-off. This creates a seismic wave that can be recorded by sensitive geophones. Analysis of the compressional P-waves and Shear S-waves (wave separation, move out, particle motion, etc.) can be used to locate fracture events in the space around the borehole. Based on this information. a map can be produced and used to identify fracture geometry, azimuth, half-length, width, height, and any other geometric property of the produced fracture.

Figure 4:
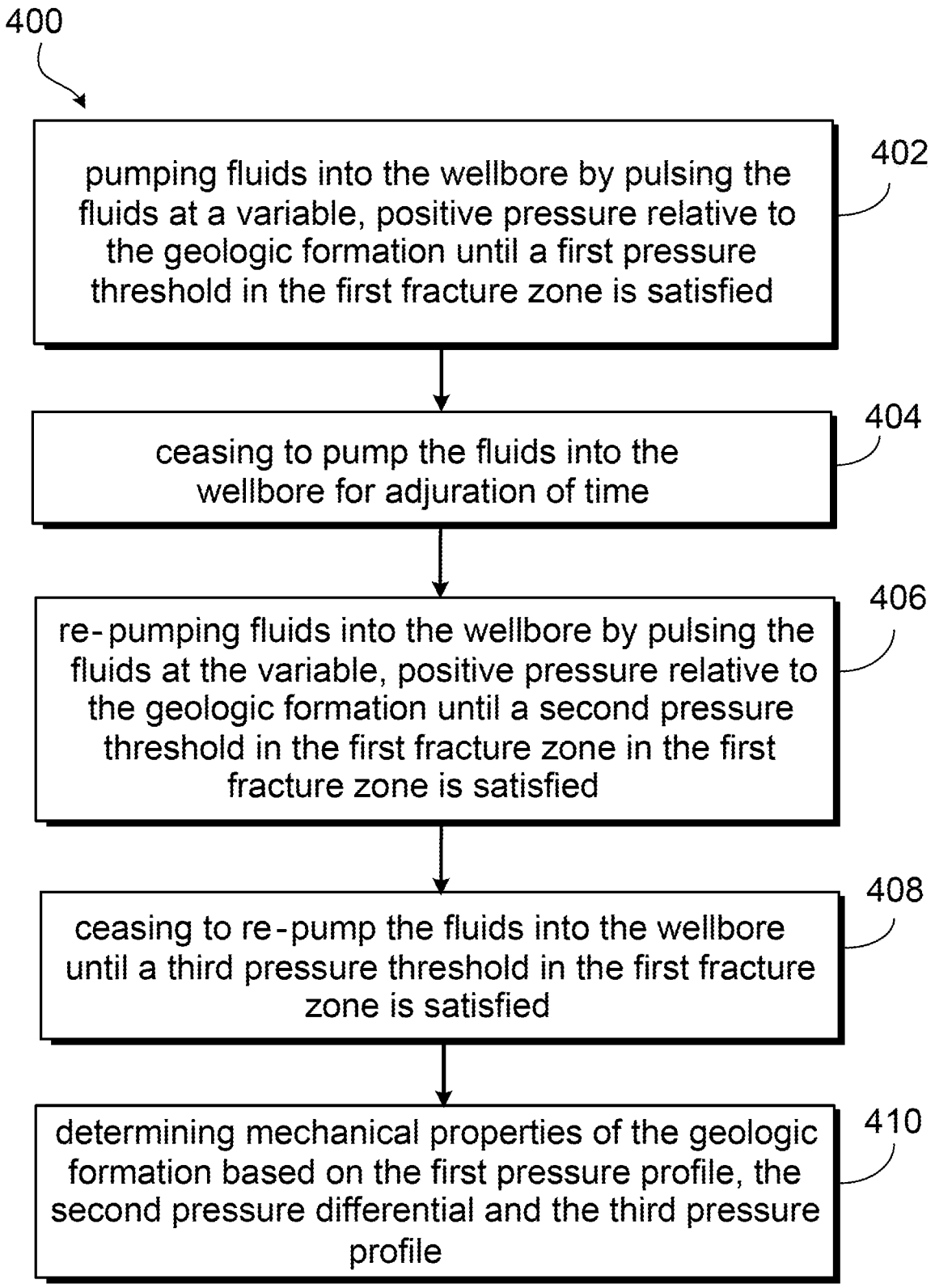
FIG. 4 is a flowchart showing an example method of an injection and fracturing interference test.

FIG. 4 is a flowchart of an example method 400 that can be used in conjunction with the wellbore tool 108 to determine geo-mechanical properties of the formation 104. All of the following steps take place within the wellbore 106. As a reminder, the formation 104 includes a first fracture zone 204 and a second zone 202 outside the first fracture zone 204. At 402, fluids are pumped into the wellbore 106 by pulsing the fluids at a variable, positive pressure relative to the geologic formation 104 until a first pressure threshold in the first fracture zone 204 is satisfied. A first set of pressure values over time in the first fracture zone 204 and a second set of pressure values over time in the second zone 202 are measured by the first sensor package 212 within the first fracture zone 204 and the second sensor package 208 within the second zone 202, respectively, while pumping the fluids into the wellbore 106. In some implementations, the recorded values can be stored with the computer 102. The pumping results in a first pressure profile in the first fracture zone 204 representing pressures in the first fracture zone 204 over time in response to the pumping. The pumping also results in a second pressure profile in the second zone 202 representing pressures in the second zone 202 over time in response to the pumping.

At 404, in response to determining that the first pressure threshold is satisfied, pumping of the fluids into the wellbore is ceased for a duration of time. In some implementations, the computer 102 can control the pumping to cease once the first pressure threshold is satisfied. During the duration of time, an additional pressure profile can be taken for the first zone 204, the second zone 202, or both. After ceasing to pump the fluids into the wellbore, a third set of pressure values is measured over time in the first fracture zone 204 by the first sensor package 212, resulting in a third pressure profile, and a fourth set of pressure values is measured over time in the second zone 202 by the second sensor package 208, resulting in a fourth pressure profile. In some implementations, the second set of pressures within the second zone 202 are determined to satisfy a pressure threshold in the first fracture zone 204 before pumping is resumed. In some implementations, the pressure threshold can be sufficiently below the first pressure threshold to allow for a pressure profile that can be used to calculate a vertical permeability. The various pressure profiles can be stored and analyzed by the computer 102.

At 406, after the duration of time, fluids are re-pumped into the wellbore 106 by pulsing the fluids at the variable, positive pressure relative to the geologic formation 104 until a second pressure threshold in the first fracture zone 204 is satisfied. The second pressure threshold is different from the first pressure threshold. For example, the second pressure threshold can be higher than the first pressure threshold. In some implementations, the second pressure threshold can be a fracturing pressure threshold. That is, a pressure necessary to start fracturing a zone of the geologic formation 104. The re-pumping results in a third pressure profile in the first fracture zone 204 representing pressures in the first fracture zone 204 over time in response to the re-pumping. In some implementations, the pumping and re-pumping steps can occur within the same trip. That is, in the single trip, the wellbore tool 108 is not removed from the wellbore 106 after ceasing the pumping and before the re-pumping. In some implementations, the pumping and re-pumping can be controlled by the computer 102.

At 408, in response to determining that the second pressure threshold is satisfied, re-pumping the fluids into the wellbore is ceased until a third pressure threshold in the first fracture zone 204 is satisfied. The third pressure threshold can be different from the second pressure threshold. For example, the third pressure threshold can be lower than the second pressure threshold. In some implementations, the third pressure threshold can be a fracture closure pressure. That is, a pressure at which fractures formed in the geologic formation 104 close after being formed.

At 410, mechanical properties of the geologic formation are determined based on the first pressure profile, the second pressure profile, and the third pressure profile. The computer 102 can be used to determine the mechanical properties. In some implementations, the geo-mechanical properties determined can include vertical permeability. For example, the vertical permeability can be determined as described earlier. In implementations where acoustic sensors are used in one or more of the sensor packages, fracture geometry can be a determined mechanical property as described earlier. The acoustic measurements necessary to determine fracture geometry can be taken during the re-pumping. That is, fracture geometry can be determined based on an acoustic response during re-pumping. The acoustic measurements can be processed by the computer 102 to determine the fracture geometry.

Implementations of the subject matter described in this specification can be implemented in a computing system that includes a back-end component, such as, as a data server, or that includes a middleware component, such as, an application server, or that includes a front-end component, such as, a client computer 102 having a graphical user interface or a Web browser through which a user can interact with an implementation of the subject matter described in this specification, or any combination of one or more such back-end, middleware, or front-end components. The components of the system can be interconnected by any form or medium of digital data communication, such as, a communication network. Examples of communication networks include a local area network ("LAN") and a wide area network ("WAN"), an inter-network (such as, the Internet), and peer-to-peer networks (such as, ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (such as, an HTML page) to a client device (such as, for purposes of displaying data to and receiving user input from a user interacting with the client device). Data generated at the client device (such as, a result of the user interaction) can be received from the client device at the server.

Figure 5:
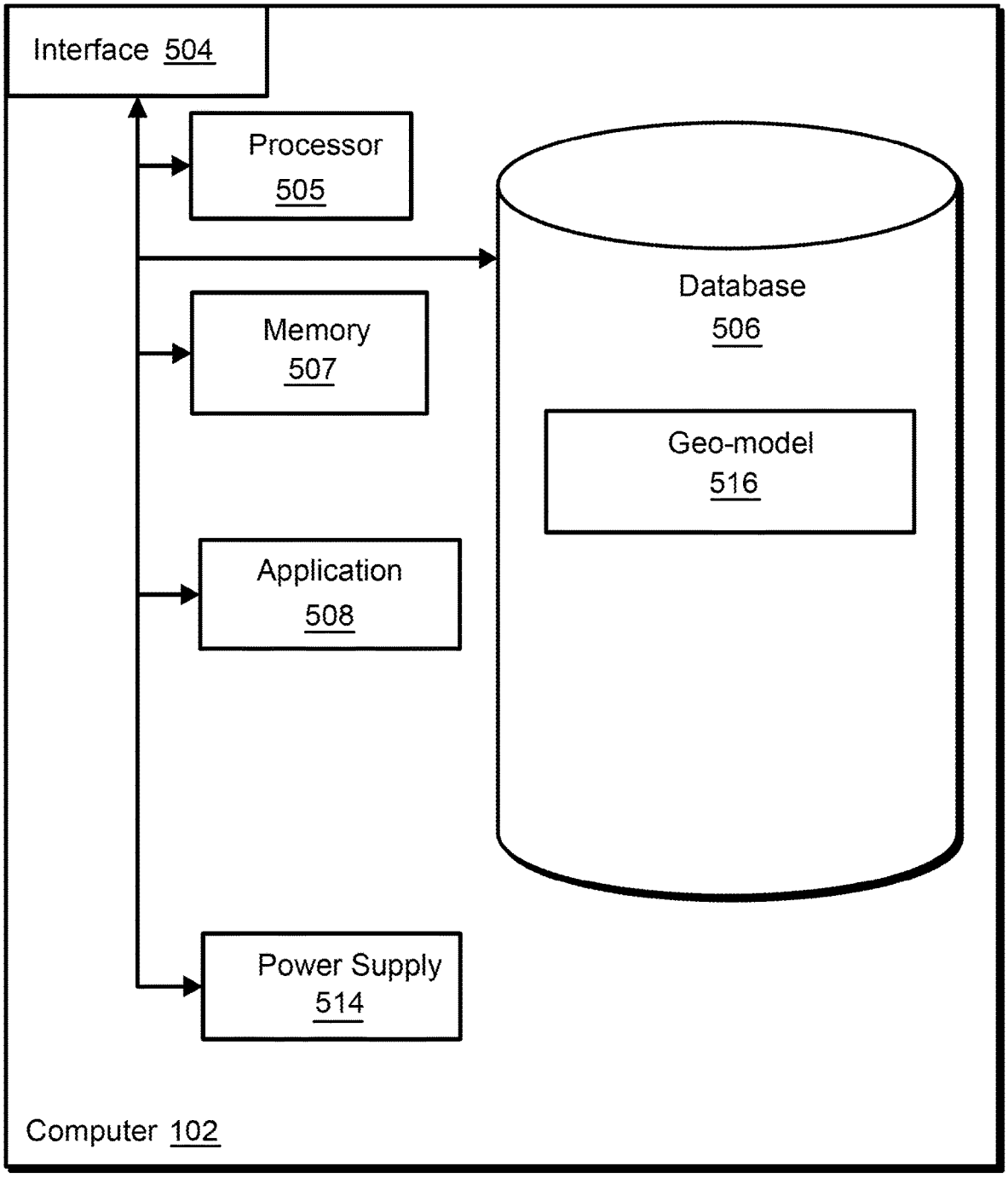
FIG. 5 is a block diagram of an example computer that can be used for analyzing the data from the injection and fracturing interference test.

An example of one such type of computer 102 is shown in FIG. 5, which shows a block diagram of a programmable computer 102 suitable for implementing apparatus or performing methods of various aspects of the subject matter described in this specification. The computer 102 includes a processor 505, a random access memory (RAM) 507, a power supply 514, a user interface 504, and an application 508 (for example, a computer program that can form a geologic model). The computer 102 can be preprogrammed, in ROM, for example, or it can be programmed (and reprogrammed) by loading a program from another source (for example, from a floppy disk, a CD-ROM, or another computer). In some implementations, the geo-model 516 can be stored in a database 506. The database 506 can be stored on the computer 102 or at an offsite storage location that can be accessed remotely by the computer 102.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described earlier as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described earlier should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous. While some implementations of the subject matter have been disclosed within this disclosure, other implementations can be used. For example, a surface frac can be performed with a similar tool to the one previously described within this disclosure. The first packer 210 and the second packer 214 can be replaces with retrievable packers. Flow-lines can be included in the center or aside to the sensors packages 208, 212 and 216. Telemetry can be ensured through the same flow-line or directly connected to the sensors packages through wireline or fiber optics or any other any other communication method.

What is claimed is:

1. A method comprising:

in a wellbore formed into a geologic formation comprising a first fracture zone and a second zone, the second zone outside the first fracture zone, the wellbore passing through both the first fracture zone and the second zone:

pumping fluids into the first fracture zone by pulsing the fluids at a variable, positive pressure relative to the geologic formation until a first pressure threshold in the first fracture zone is satisfied, wherein the pumping results in a first pressure profile in the first fracture zone representing pressures in the first fracture zone over time responsive to the pumping, and a second pressure profile in the second zone representing pressures in the second zone over time responsive to the pumping;

in response to determining that the first pressure threshold is satisfied, ceasing to pump the fluids into the first fracture zone for a duration of time;

after the duration of time, re-pumping fluids into the first fracture zone by pulsing the fluids at the variable, positive pressure relative to the geologic formation until a second pressure threshold in the first fracture zone is satisfied, the second pressure threshold different from the first pressure threshold, wherein the re-pumping results in a third pressure profile in the first fracture zone representing pressures in the first fracture zone over time responsive to the pumping;

in response to determining that the second pressure threshold is satisfied, ceasing to re-pump the fluids into the first fracture zone until a third pressure threshold in the first fracture zone is satisfied, the third pressure threshold different from the second pressure threshold; and determining mechanical properties of the geologic formation based on the first pressure profile, the second pressure profile, and the third pressure profile.

2. The method of claim 1, wherein the second pressure threshold is greater than the first pressure threshold.

3. The method of claim 1, further wherein the determined mechanical properties comprise a vertical permeability.

4. The method of claim 1, further comprising measuring, during the re-pumping, an acoustic response, and wherein the mechanical properties comprise fracture geometry determined based on the acoustic response.

5. The method of claim 4, further comprising:

while pumping the fluids into the first fracture zone, measuring, by a first sensor in the first fracture zone and a second sensor in the second zone, a first plurality of pressure values over time in the first fracture zone and a second plurality of pressure values over time in the second zone, respectively; and determining that the second plurality of pressure values within the second zone satisfy a pressure threshold in the first fracture zone.

6. The method of claim 5, comprising, after ceasing to pump the fluids into the first fracture zone, measuring, by the first sensor and the second sensor, a third plurality of pressure values over time in the first fracture zone and a fourth plurality of pressure values over time in the second zone, respectively.

7. The method of claim 1, wherein the pumping and re-pumping are implemented in a single trip of a wellbore tool into the wellbore.

8. The method of claim 7, wherein, in the single trip, the wellbore tool is not removed from within the wellbore after ceasing the pumping and before the re-pumping.

* * * * *